US008303385B2

(12) United States Patent
Park

(10) Patent No.: US 8,303,385 B2
(45) Date of Patent: Nov. 6, 2012

(54) STATIONARY VENTILATING DEVICE

(76) Inventor: Tai Up Park, Gwangmyeong-si (KR)

( * ) Notice: Subject to any disclaimer, the term of this patent is extended or adjusted under 35 U.S.C. 154(b) by 644 days.

(21) Appl. No.: 12/514,868

(22) PCT Filed: Nov. 8, 2007

(86) PCT No.: PCT/KR2007/005611

§ 371 (c)(1),
(2), (4) Date: May 14, 2009

(87) PCT Pub. No.: WO2008/060066

PCT Pub. Date: May 22, 2008

(65) Prior Publication Data

US 2010/0068985 A1 Mar. 18, 2010

(30) Foreign Application Priority Data

Nov. 14, 2006 (KR) ..... 20-2006-0029564 U

(51) Int. Cl.
*F24F 7/06* (2006.01)

(52) U.S. Cl. ..... 454/341; 454/339

(58) Field of Classification Search ..... 108/183, 108/60, 64, 65, 91, 92; 215/249, 250, 256, 215/263; 454/33, 35, 39, 6, 341, 367–368; 248/342

See application file for complete search history.

(56) References Cited

U.S. PATENT DOCUMENTS

| | | | | | |
|---|---|---|---|---|---|
| 320,794 | A | * | 6/1885 | Kayser et al. | 454/33 |
| 2,478,761 | A | * | 8/1949 | Houseman | 454/18 |
| 2,605,693 | A | * | 8/1952 | Hansen | 454/33 |
| 2,830,526 | A | * | 4/1958 | Breidert | 454/33 |
| 2,922,354 | A | * | 1/1960 | Breidert et al. | 454/33 |
| 3,049,068 | A | * | 8/1962 | Rousey | 454/33 |
| 3,064,638 | A | * | 11/1962 | Bauer | 126/110 AA |
| 4,638,727 | A | * | 1/1987 | Mitchell | 454/33 |
| D609,798 | S | * | 2/2010 | Matejczuk | D23/374 |

FOREIGN PATENT DOCUMENTS

| | | | |
|---|---|---|---|
| JP | 59-191533 | | 12/1984 |
| JP | 61-031835 | | 2/1986 |
| JP | 61031835 | * | 2/1986 |
| KR | 1020020064476 A | * | 9/2002 |
| KR | 100436840 | | 6/2004 |

* cited by examiner

*Primary Examiner* — Steven B McAllister
*Assistant Examiner* — Jamil Decker
(74) *Attorney, Agent, or Firm* — The PL Law Group, PLLC

(57) ABSTRACT

A stationary ventilating device for efficiently exhausting airflow converged above a plurality of airflow-guiding plates which are stacked up and assembled together is disclosed. A stationary ventilating device in accordance with the present invention comprises a base, a plurality of airflow-guiding plates stacked-up and assembled together on the base, a plurality of guiding members each of which is interposed between the plurality of airflow-guiding plates, and a covering plate including supporting legs on a lower side of the covering plate, the supporting legs vertically erected and installed on an uppermost airflow-guiding plate of the plurality of airflow-guiding plates so that a ventilating passage is formed on the upper side of the uppermost airflow-guiding plate, wherein the slope angle of lateral side of the covering plate is formed to be smaller than the slope angle of lateral sides of the plurality of airflow-guiding plates, and wherein airflows rising from the plurality of airflow-guiding plates flow backward in the covering plate and are ventilated through the ventilating passage.

10 Claims, 9 Drawing Sheets

PRIOR ART (a)
PRIOR ART (b)

STATIONARY VENTILATING DEVICE

CROSS REFERENCE TO RELATED APPLICATION

This application claims the priority of Korean Patent Application No. 20-2006-0029564, filed on Nov. 14, 2006 in the KIPO (Korean Intellectual Property Office), the disclosure of which is incorporated herein in their entirety by reference. Further, this application is the National Phase application of International Application No. PCT/KR2007/005611, filed Nov. 8, 2007, which designates the United States and was published in English. Each of these applications is hereby incorporated by reference in their entirety into the present application.

TECHNICAL FIELD

The present invention relates to a stationary ventilating device, and more particularly to a stationary ventilating device for efficiently exhausting airflow converged above a plurality of airflow-guiding plates which are stacked up and assembled together.

BACKGROUND ART

A stationary ventilation known in the prior art is disclosed in the pamphlet of Korean registered patent assigned Serial No. 10-436840, and is illustrated in FIG. 1 enclosed herewith.

As shown in FIG. 1, a stationary ventilating device described in the pamphlet comprises a base 140, a plurality of first airflow-guiding plates 120 stacked-up and assembled on the base 140, a plurality of guiding members 130 each of which is interposed between the first airflow-guiding plate 120, a second airflow-guiding plate 100 installed in the uppermost story in the device and combined with the guiding member 130 on the uppermost first airflow-guiding plate 120, a fan for compulsory ventilation (not shown) which is installed inside the base 140, wherein each of the plurality of first airflow-guiding plates 120 and the second airflow-guiding plate 100 is provided with aperture 141 and 143 respectively for receiving a bolt 141 which is fixed by means of a nut 143, whereby the plurality of first airflow-guiding plates 120 and the second airflow-guiding plate 100 are stacked up and assembled together.

However, the stationary ventilating device in accordance with the above-mentioned prior-art has problems as follows.

The second airflow-guiding plate 100 and the plurality of first airflow-guiding plates 120 stacked up under the second airflow-guiding plate 100 have the same angle of lateral slope, and thereby an uppermost room is formed by the height of the slope. A portion of the airflow rises and converges into the uppermost room and as a result, a resisting force is generated due to the converged airflow. In other words, there is the problem that ventilating the rising airflow efficiently is impossible due to the resisting airflow generated in the uppermost room.

DISCLOSURE

Technical Problem

In order to solve the above-mentioned problems, one object of the present invention is to provide a stationary ventilating device wherein the shape and structure of the uppermost airflow-guiding plate is improved so as to minimize the uppermost room which results in the generation of the resisting force due to the airflow converged into the uppermost room in the device.

Technical Solution

To achieve the above-mentioned objects, according to an embodiment of the present invention, there is provided a stationary ventilating device including a base, a plurality of airflow-guiding plates stacked-up and assembled together on the base, a plurality of guiding members each of which is interposed between the plurality of airflow-guiding plates, and a covering plate including supporting legs on a lower side of the covering plate, the supporting legs vertically erected and installed on an uppermost airflow-guiding plate of the plurality of airflow-guiding plates so that a ventilating passage is formed on the upper side of the uppermost airflow-guiding plate, wherein the slope angle of lateral side of the covering plate is formed to be smaller than the slope angle of lateral sides of the plurality of airflow-guiding plates, and wherein airflows rising from the plurality of airflow-guiding plates flow backward in the covering plate and are ventilated through the ventilating passage.

Preferably, the device further comprises a flat plate for collecting solar heat on the top of the covering plate, wherein the flat plate is combined by means of perforated joint so as to be easily cut off.

Preferably, the device further comprises a fan positioned horizontally to at least one of the plurality of guiding members.

Preferably, the guiding member includes a vertical wall, a hollow supporting rod which a long bolt passes through, and a plurality of supporting wings formed in its circumference in a radial shape.

Advantageous Effects

By installing supporting legs in the covering plate, a stationary ventilating device in accordance with the present invention can improve the phenomenon that the lower side of space formed by a covering plate is blocked. As a result, the present invention has an effect that converged airflows rising from the bottom of the device can be ventilated smoothly through the ventilating passage.

Further, the present invention has an effect that resisting forces against rising airflows can be reduced remarkably by reducing the inner space (height) of the covering plate and exhausting rising airflows through the ventilating passage in order to reduce backward airflows.

Furthermore, the present invention has an effect that blocked airflows that often occur to ventilating equipments where a stationary ventilating device is installed can be exhausted efficiently by installing a fan 4 in a position horizontal to the guiding members each of which is interposed between the airflow-guiding plates 40 and 60.

BEST MODE

Figure 1:
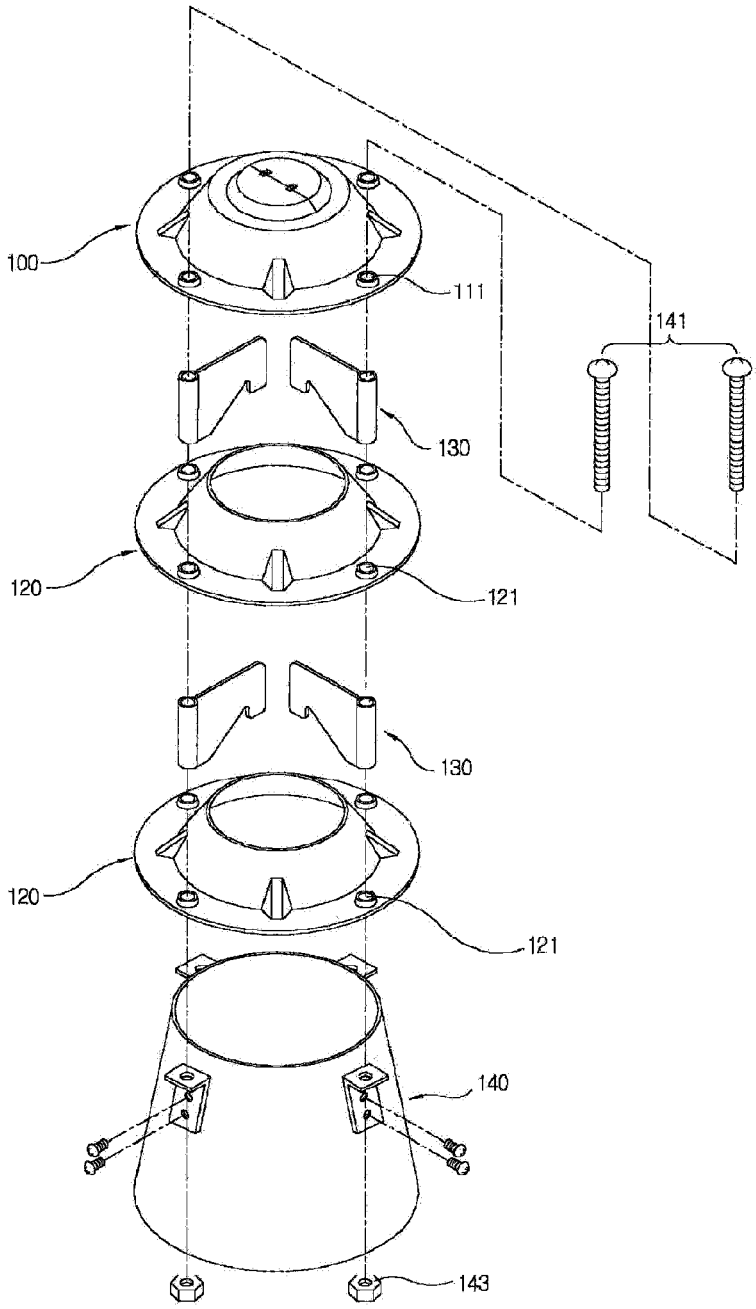
FIG. 1 is a exploded and perspective view illustrating a prior art stationary ventilating device.

The embodiments are now described with reference to the drawings, wherein like reference numerals are used to refer to like elements throughout.

Figure 2:
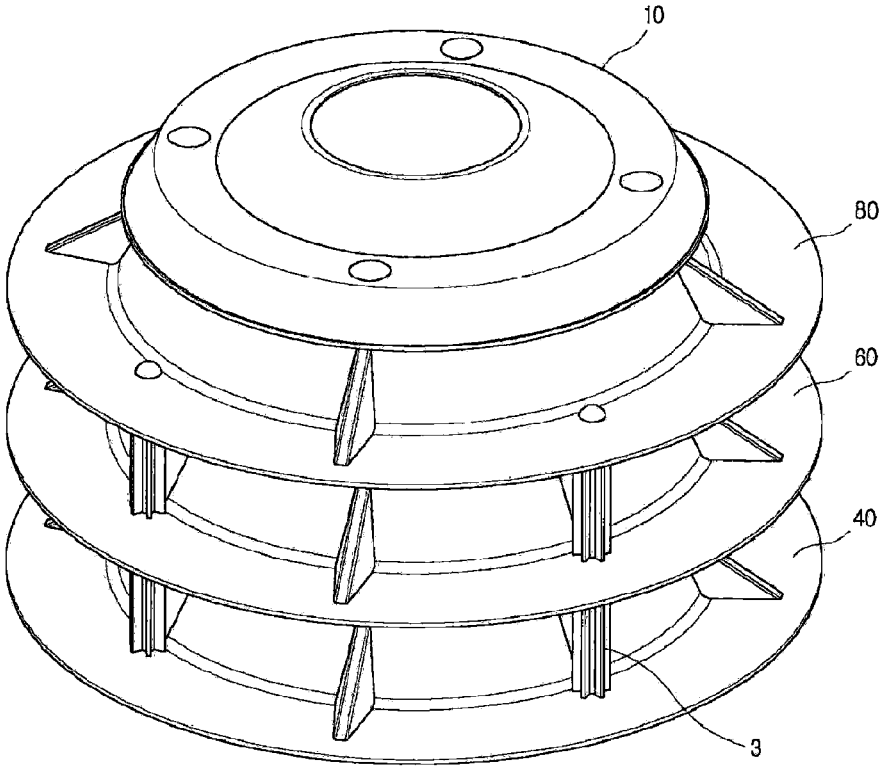
FIG. 2 is a perspective view illustrating the appearance of a stationary ventilating device in accordance with the present invention.
Figure 3:
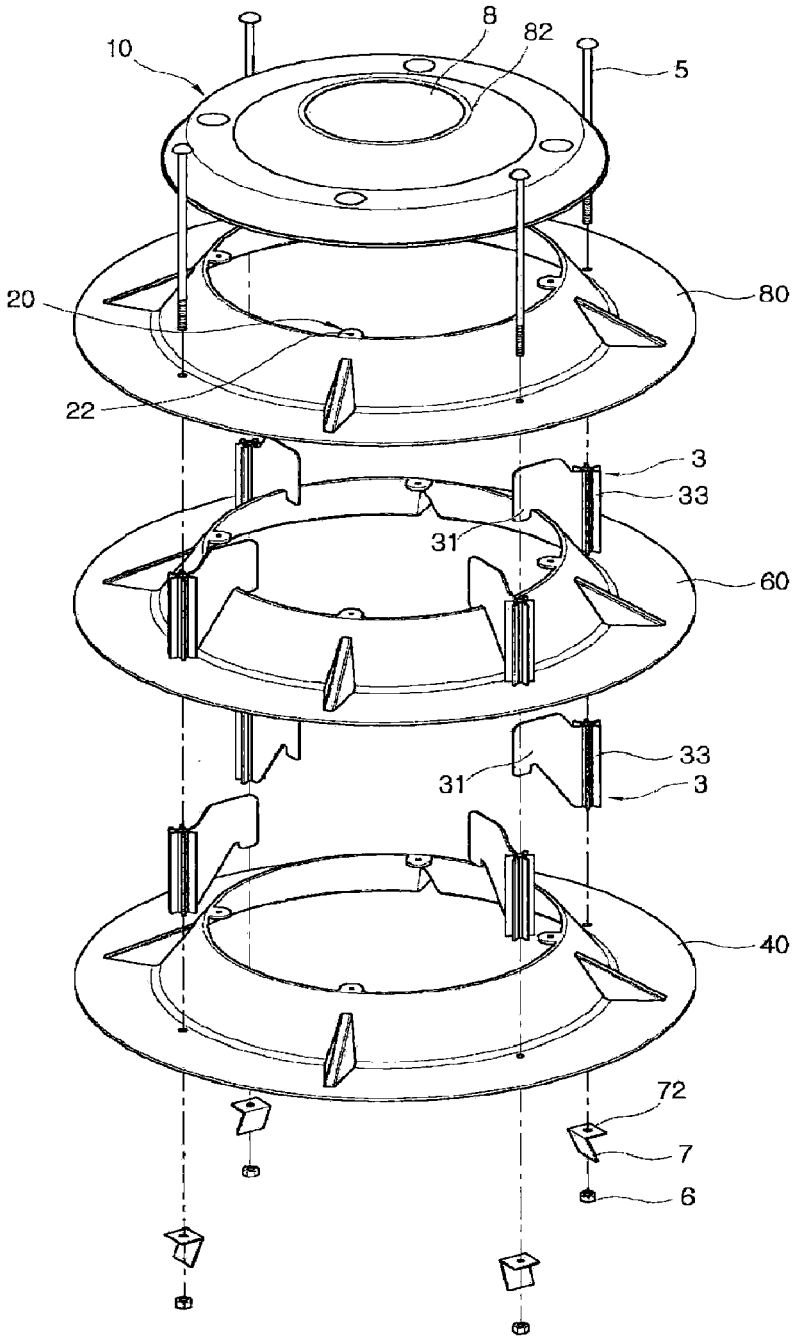
FIG. 3 is a exploded and perspective view of the stationary ventilating device in accordance with the present invention.
Figure 4:
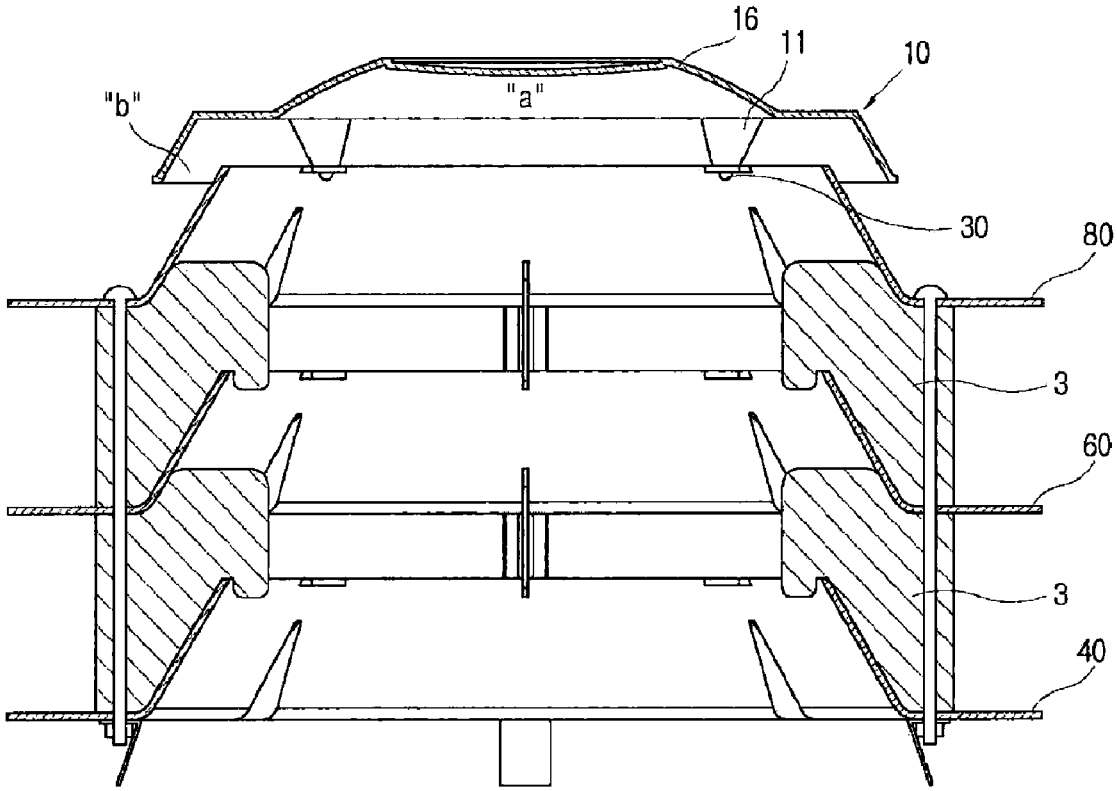
FIG. 4 is a cross-sectional view of the stationary ventilating device in accordance with the present invention.
Figure 5:
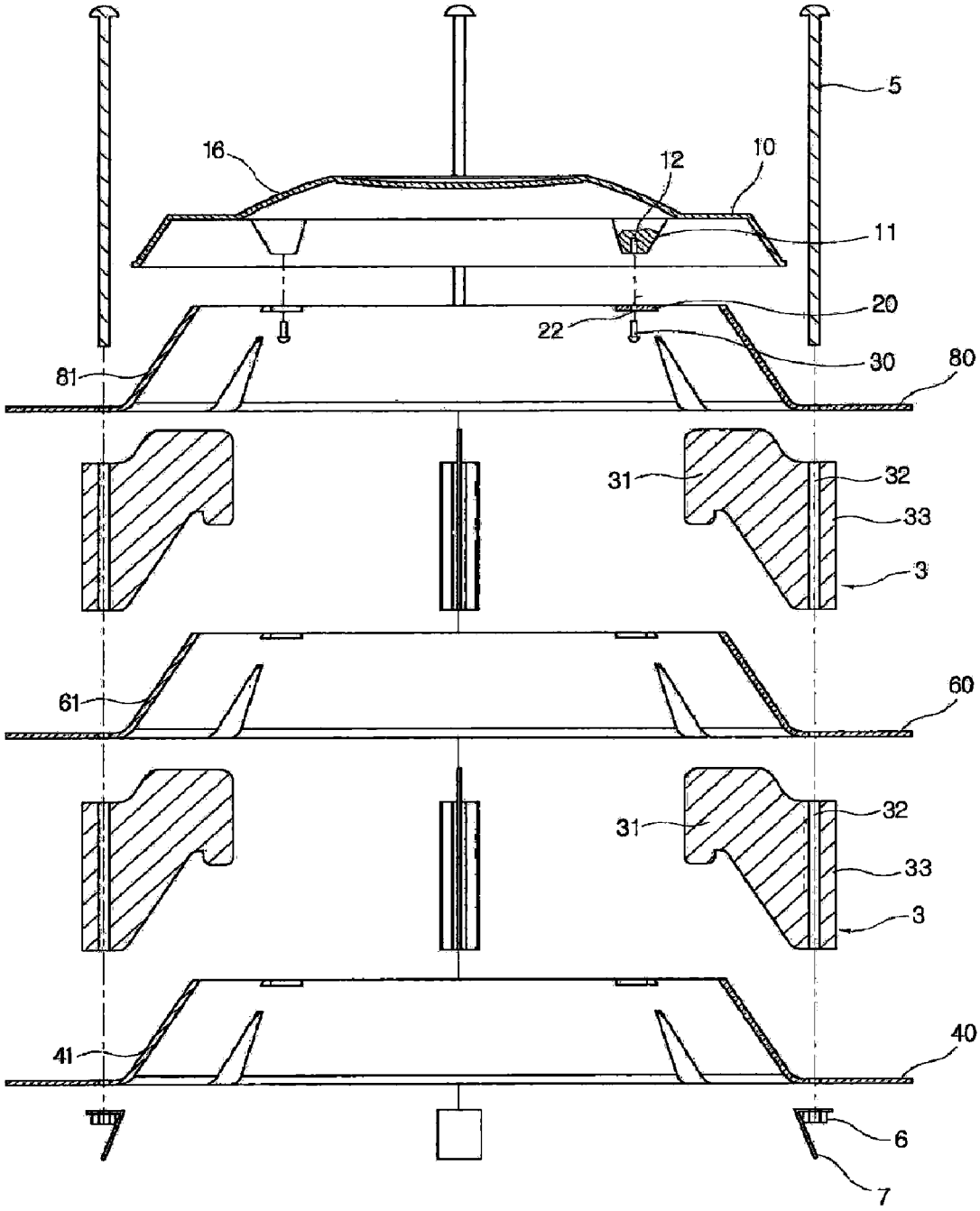
FIG. 5 is a exploded and cross-sectional view of the stationary ventilating device in accordance with the present invention.

FIG. 2 is a perspective view illustrating the appearance of a stationary ventilating device in accordance with the present invention, FIG. 3 is a exploded and perspective view of the stationary ventilating device in accordance with the present invention, FIG. 4 is a cross-sectional view of the stationary ventilating device in accordance with the present invention and FIG. 5 is a exploded and cross-sectional view of the stationary ventilating device in accordance with the present invention.

The stationary ventilating device in accordance with the present invention comprises a plurality of airflow-guiding plates 40, 60 and 80 stacked-up and assembled together, a plurality of guiding members 3 each of which is interposed between the plurality of airflow-guiding plates 40, 60 and 80, a covering plate 10 installed on the uppermost airflow-guiding plate 80, supporting parts 7 with an aperture 72 for stacking up and assemble the plurality of airflow-guiding plates 40, 60 and 80, long bolts 5 and nuts 6.

Particularly, the covering plate 10 includes supporting legs 11 with a predetermined height which are formed downward so that a ventilating passage b open to all directions is formed between a lower side of covering plate 10 and an upper side of the uppermost airflow guiding plate 80.

Accordingly, converged airflows rising from the bottom of the device can be ventilated smoothly through the ventilating passage 'b' out of the inner space 'a' of the covering plate 10.

A receiving hole 12 is formed at the lower end of the supporting leg 11, and a connecting part 20 with a connecting hole 22 is formed along the inner circumference of the uppermost airflow-guiding pate 80 where the supporting leg 11 is vertically erected and installed. The supporting leg 11 is secured to the uppermost airflow-guiding plate 80 by means of a connecting bolt 30 which passes through the connecting hole 22 and is screwed up into the receiving hole 12.

In addition, the slope angle of lateral side 16 of the covering plate 10 is formed to be smaller than the slope angle of lateral side 41, 61, 81 of the airflow-guiding plate 40, 60, 80 so as to reduce the inner space 'a' of covering plate 10, and thereby the amount of rising airflows converged into the inner space 'a' can be reduced. As a result, resisting airflows which are reflected on the upper side of the covering plate 10 and flow downward can be reduced.

Further, the ventilating in accordance with the present invention comprises a flat plate 8 for collecting solar heat in the center of the top of the covering plate 10 wherein the flat plate is combined by means of perforated joint 82 so as to be easily cut off. Accordingly, if necessary, the top of the covering plate 10 can be opened by cutting off the flat plate 8.

Furthermore, the guiding member 3 includes a vertical wall 31 and a hollow supporting rod 32 which the long bolt 5 passes through, and preferably, a plurality of supporting wings 33 may be formed in its circumference in a radial shape so that the guiding member 3 can support the airflow-guiding plates 40, 60 and 80 stably.

Figure 6:
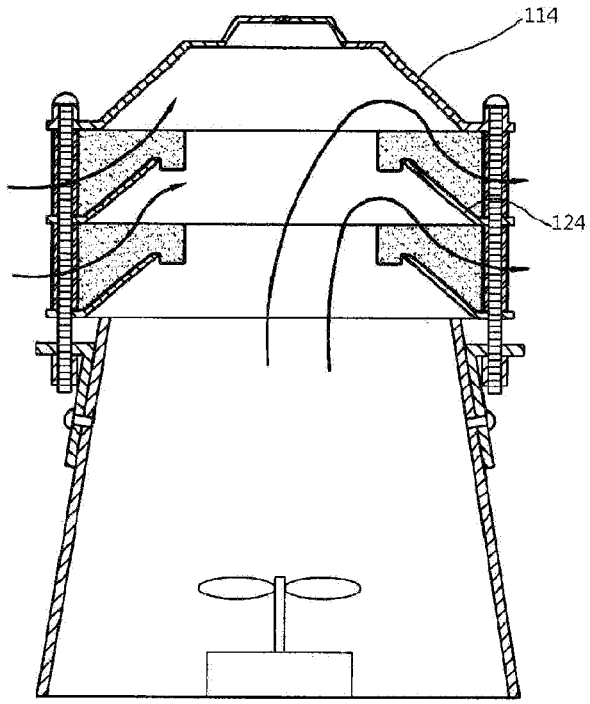
FIG. 6(*a*) is a partial and cross-sectional view illustrating the function of the prior art stationary ventilating device shown in FIG. 1, and FIG. 6(*b*) is a partial and cross-sectional view illustrating the function of the stationary ventilating device in accordance with the present invention.
Figure 6:
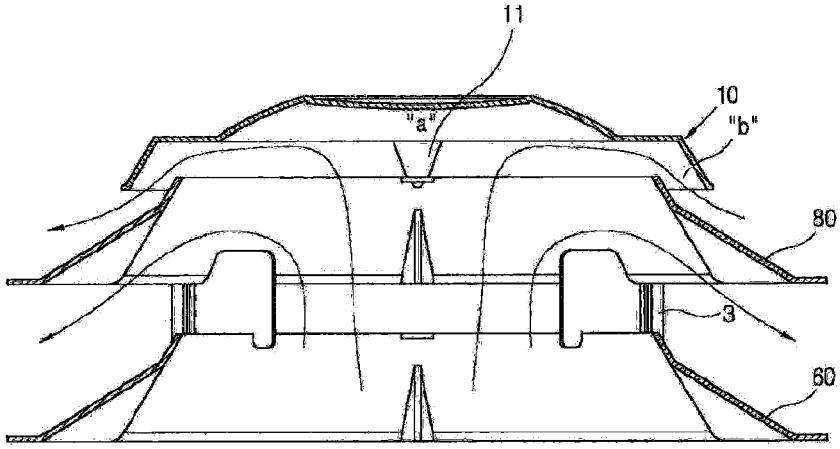

Next, FIG. 6(*a*) is a partial and cross-sectional view illustrating the function of the prior art stationary ventilating device shown in FIG. 1, and FIG. 6(*b*) is a partial and cross-sectional view illustrating the function of the stationary ventilating device in accordance with the present invention.

As shown in FIG. 6(*a*), in the prior art stationary ventilating device, there is a problem that rising airflows flow backward due to resisting forces generated by the closure of lower sides of the uppermost second airflow-guiding plate 100.

In addition, in the prior art stationary ventilating device, a lateral side 114 of the uppermost second airflow-guiding plate 100 has the same slope as a lateral 124 of the first airflow-guiding plate 120. Accordingly, there is a problem that the rising airflows which flow into the inner space of the second airflow-guiding plate 100 are not ventilated efficiently.

On the other side, as shown in FIG. 6(*b*), in accordance with the present invention, the covering plate 10 includes the supporting legs 11 formed downward so that a ventilating passage 'b' open to all directions is formed between the covering plate 10 and an upper side of the uppermost airflow guiding plate 80.

Accordingly, airflows converged into inner space 'a' of the covering plate 10 can be ventilated smoothly through the ventilating passage open to all directions.

In addition, the slope angle of lateral side 16 of the covering plate 10 is formed to be smaller than the slope angle of lateral side 41, 61, 81 of the airflow-guiding plate 40, 60, 80 so as to reduce the inner space 'a' of covering plate 10, and thereby the amount of rising airflows converged into the inner space 'a' can be reduced. As a result, resisting airflows which are reflected on the upper side of the covering plate 10 and flow downward can be reduced.

In other words, in accordance with the stationary ventilating device of the present invention, by reducing the height of the space 'a' formed inside the covering plate 10 and ventilating the rising airflow through the ventilating passage 'b', airflows which flow downward in the inner space of the covering plate are reduced. As a result, resisting force against the rising airflows is reduced remarkably.

Figure 7:
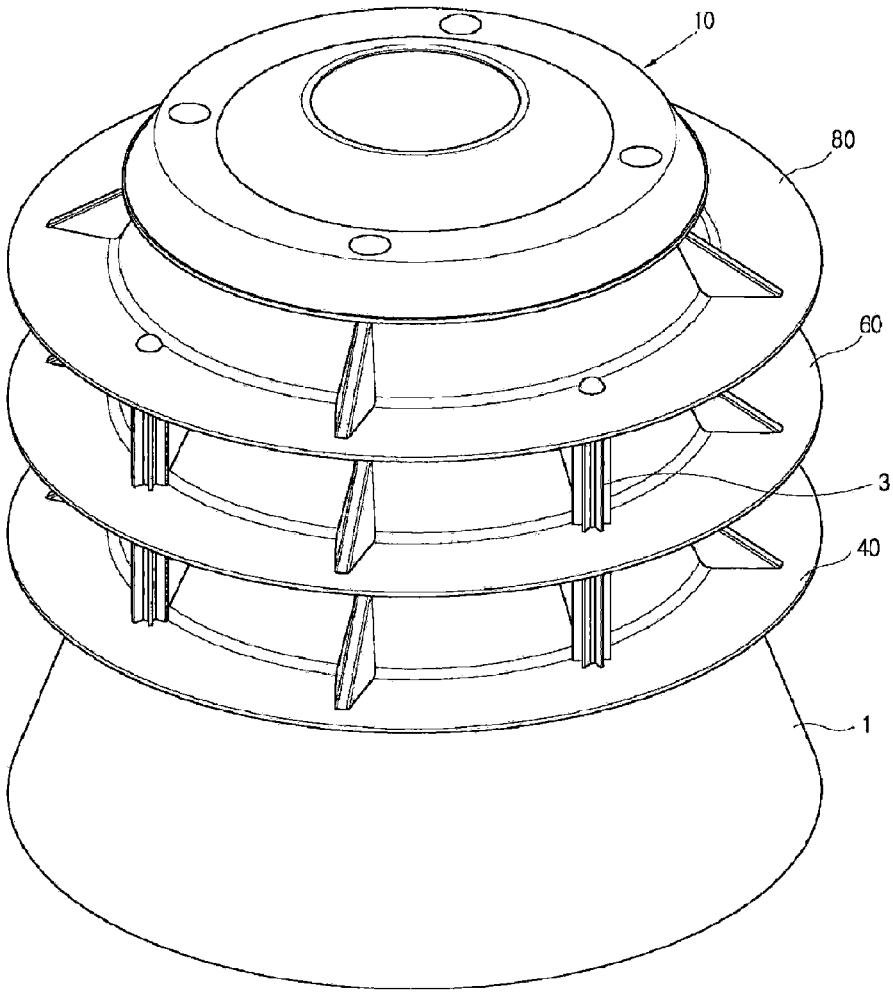
FIG. 7 is a perspective view illustrating the state that the stationary ventilating device in accordance with the present invention is assembled on a supporting part.
Figure 8:
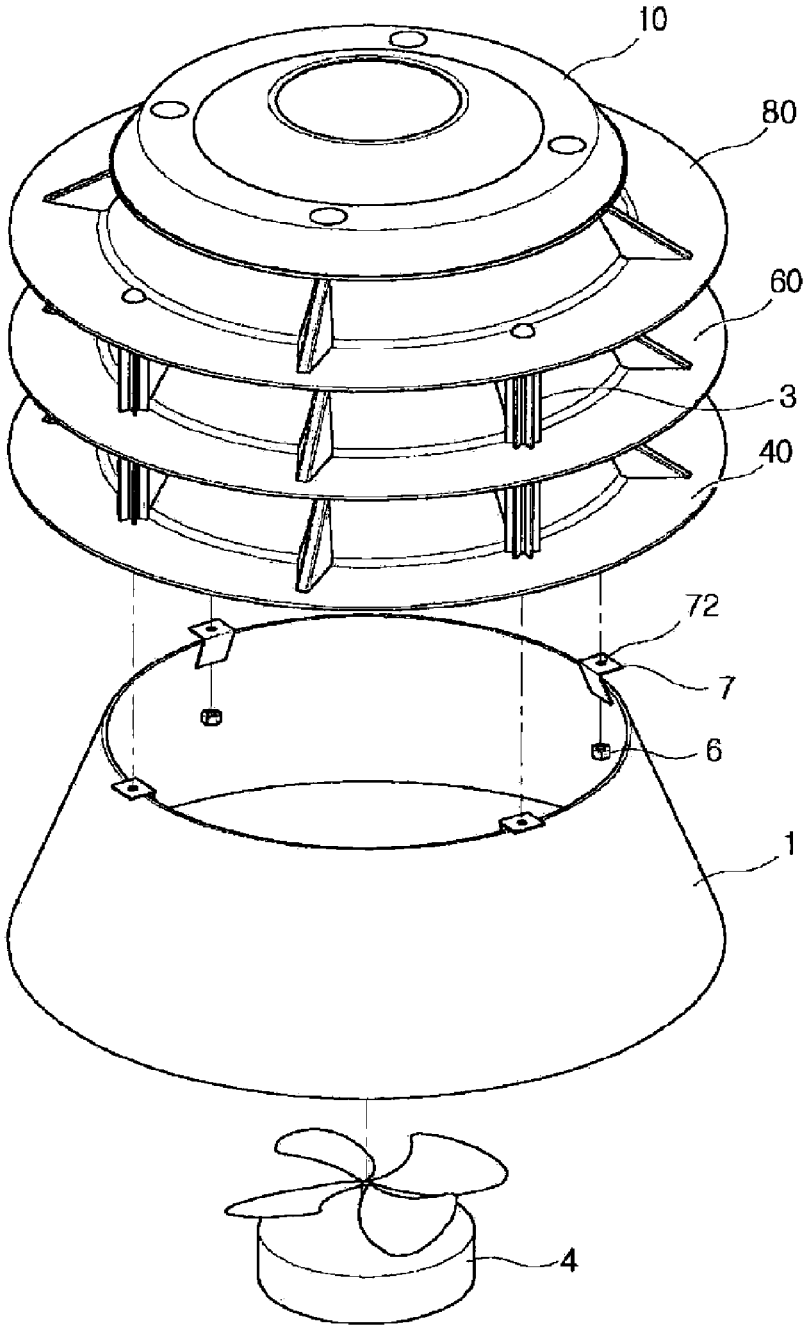
FIG. 8 is a exploded and perspective view of the stationary ventilating device in accordance with the present invention before the device is installed.
Figure 9:
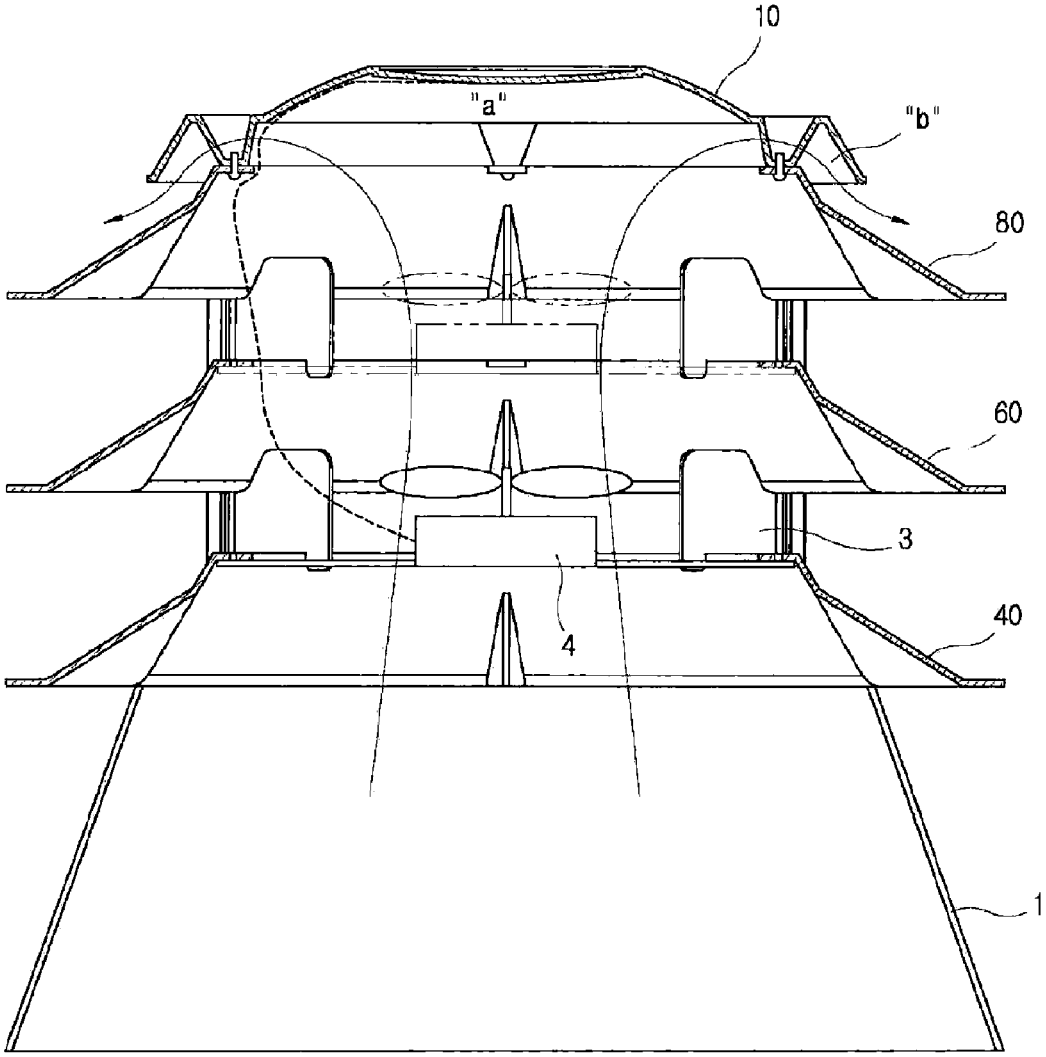
FIG. 9 is a functional and cross-sectional view of the stationary ventilating device in accordance with the present invention after the device is installed.

Next, FIG. 7 is a perspective view illustrating the state that the stationary ventilating device in accordance with the present invention is assembled on a supporting part, FIG. 8 is a exploded and perspective view of the stationary ventilating device in accordance with the present invention before the device is installed, and FIG. 9 is a functional and cross-sectional view of the stationary ventilating device in accordance with the present invention after the device is installed.

As shown in FIGS. 7 to 9, the stationary ventilating device in accordance with the present invention comprises a plurality of airflow-guiding plates 40, 60 and 80 stacked-up and assembled on a base 1, a plurality of guiding members 3 each of which is interposed between the plurality of airflow-guiding plates 40, 60 and 80, a fan 4 for compulsory ventilation positioned horizontally to the guiding members 3 inside the device, a plurality of supporting parts 7 for stacking up and assemble the plurality of airflow-guiding plates 40, 60 and 80, long bolts 5 and nuts 6. An aperture 72 is formed in the supporting part 7 and is fixed by means of bolts (not shown).

Particularly, the device includes a covering plate 10 with a predetermined height of a supporting leg 11 so as to open sloped sides of prior art airflow-guiding plate whose top is closed.

A receiving hole 12 is formed at the lower end of the supporting leg 11, and a connecting part 20 with a connecting hole 22 is formed along the inner circumference of the uppermost airflow-guiding pate 80 where the supporting leg 11 is vertically installed. The supporting leg 11 is secured to the uppermost airflow-guiding plate 80 by means of a connecting bolt 30 which passes through the connecting hole 22 and is screwed up into the receiving hole 12.

Accordingly, because the inner space 'a' of the covering plate 10 is not blocked by sloped walls differently from the prior art stationary ventilating device and is connected to the ventilating passage 'b' open to all directions, converged airflows rising from the bottom of the device can be ventilated smoothly. As a result, blocked airflows that often occur to the top of ventilating equipments wherein a fan 4 is installed inside the base 1 can be exhausted efficiently.

In addition, the stationary ventilating device in accordance with the present invention has the characteristic of being able to ventilate and exhaust inner airflows under the condition that there is no movement of inner airflows, by comprising a fan 4 for compulsory ventilation positioned horizontally to the guiding members 3 each of which is interposed between the airflow-guiding plates 40, 60 and 80.

Although the present invention has been described in connection with the specific embodiments, the present invention is not limited to the embodiments and should be interpreted to have the widest range according to the basic spirit disclosed in the specification. In addition, those skilled in the art can easily change the disclosed embodiments based on the specification. It is evident that such modifications and alternations also fall within the scope of the present invention. Hereinafter, embodiments of the present invention will be described as follows with reference to the attached drawings.

What is claimed is:

1. A stationary ventilating device, comprising:

a base;

a plurality of airflow-guiding plates stacked-up and assembled together on the base;

a plurality of guiding members each of which is interposed between the plurality of airflow-guiding plates;

a covering plate including supporting legs formed on a lower side of the covering plate, the supporting legs vertically erected and installed on an inner circumference of an uppermost airflow-guiding plate of the plurality of airflow-guiding plates so that a ventilating passage is formed on the side having a sloped section of the uppermost airflow-guiding plate, the covering plate further comprising a raised portion located radially inward of the outer circumference of the covering plate; and a fan positioned horizontally to at least one of the plurality of guiding members for compulsory ventilation;

wherein the plurality of airflow-guiding plates have the same slope angle, and the slope angle of the sloped section of the covering plate is formed to be smaller than the slope angle of lateral sides of the plurality of airflow-guiding plates;

wherein airflows that rise from the plurality of airflow-guiding plates, are converged into an inner space of the covering plate and flow downward and are ventilated through the ventilating passage; and wherein the plurality of airflow-guiding plates have the same height, and a height of the covering plate is smaller than the height of the plurality of airflow-guiding plates.

2. The device according to claim 1, further comprising a flat plate for collecting solar heat on the top of the covering plate, wherein the flat plate is combined by means of perforated joint so as to be easily cut off.

3. The device according to claim 1, wherein the guiding member includes a vertical wall, a hollow supporting rod through which a bolt passes, and a plurality of supporting wings formed in its circumference in a radial shape.

4. The device according to claim 1, wherein the supporting leg is vertically installed at an inner circumference of the uppermost airflow-guiding pate.

5. The device according to claim 1, wherein a lower end of each of the supporting legs has a receiving hole;

a connecting part with a connecting hole is formed along an inner circumference of the uppermost airflow-guiding pate; and the supporting leg is secured to the uppermost airflow-guiding plate by a connecting bolt passing through the connecting hole and is screwed up into the receiving hole.

6. A stationary ventilating device, comprising:

a base;

a plurality of airflow-guiding plates stacked-up and assembled together on the base;

a plurality of guiding members each of which is interposed between the plurality of airflow-guiding plates; and a covering plate including supporting legs formed on a lower side of the covering plate, the supporting legs vertically erected and installed on an inner circumference of an uppermost airflow-guiding plate of the plurality of airflow-guiding plates so that a ventilating passage is formed on the side having a sloped section of the uppermost airflow-guiding plate, the covering plate further comprising a raised portion located radially inward of the outer circumference of the covering plate;

wherein the slope angle of the sloped section of the covering plate is formed to be smaller than the slope angle of lateral sides of the plurality of airflow-guiding plates;

wherein a lower end of the supporting leg has a receiving hole, and a connecting part with a connecting hole is formed along an inner circumference of the uppermost airflow-guiding plate, and the supporting leg is secured to the uppermost airflow-guiding plate by a connecting bolt passing through the connecting hole and is screwed up into the receiving hole; and wherein the plurality of airflow-guiding plates have the same height, and a height of the covering plate is smaller than the height of the plurality of airflow-guiding plates.

7. The device according to claim 6, wherein the guiding member includes a vertical wall, a hollow supporting rod through which a bolt passes, and a plurality of supporting wings formed in its circumference in a radial shape.

8. The device according to claim 7, wherein each of the plurality of airflow-guiding plates has apertures receiving bolts to stack-up and assemble the plurality of airflow guiding plates together on the base, and the apertures and the hollow supporting rod are interconnected to each other.

9. The device according to claim 6, wherein each of the plurality of airflow-guiding plates have the lateral sides and are provided with aperture respectively for receiving a bolt fixed by a nut, whereby the plurality of airflow-guiding plates are stacked up and assembled together.

10. The device according to claim 6, further comprising a fan positioned horizontally to at least one of the plurality of guiding members for compulsory ventilation.

* * * * *